United States Patent [19]

Jones

[11] Patent Number: 4,732,622

[45] Date of Patent: Mar. 22, 1988

[54] PROCESSING OF HIGH TEMPERATURE ALLOYS

[75] Inventor: Andrew R. Jones, Preston, England

[73] Assignee: United Kingdom Atomic Energy Authority, London, England

[21] Appl. No.: 910,688

[22] Filed: Sep. 23, 1986

[30] Foreign Application Priority Data

Oct. 10, 1985 [GB] United Kingdom ..... 8524977
Oct. 10, 1985 [GB] United Kingdom ..... 8524976

[51] Int. Cl.[4] ..... C21D 8/00

[52] U.S. Cl. ..... 148/11.5 P; 148/126.1; 148/320; 148/325; 419/31; 419/32; 419/38; 419/41; 419/44; 419/55; 419/67

[58] Field of Search ..... 148/11.5 P, 126.1; 419/31, 32, 38, 41, 44, 55, 67

[56] References Cited

U.S. PATENT DOCUMENTS 3,366,515 1/1968 Fraser et al. ..... 148/11.5 P
4,156,053 2/1979 Baranow ..... 428/570
4,585,619 4/1986 Westin ..... 419/38

FOREIGN PATENT DOCUMENTS 0088578 9/1983 European Pat. Off. .
1265343 3/1972 United Kingdom .
1298944 12/1972 United Kingdom .
1407867 9/1975 United Kingdom .
1413762 11/1975 United Kingdom .
1524502 9/1978 United Kingdom .

*Primary Examiner*—L. Dewayne Rutledge
*Assistant Examiner*—George Wyszomierski
*Attorney, Agent, or Firm*—William R. Hinds

[57] ABSTRACT

A method of producing products from a mechanically alloyed, dispersion strengthened iron-base powder comprises consolidating the powder and working the consolidated body to the desired product shape. To obtain a desired grain size in the product, the process includes at least two stages of recrystallization annealing which may be effected after consolidation or alternatively at least one of the recrystallization anneals may be carried out while the material is still in powder form.

16 Claims, No Drawings

PROCESSING OF HIGH TEMPERATURE ALLOYS

This invention relates to the processing of high temperature alloys and is particularly concerned with the production of products composed of mechanically-alloyed, dispersion-strengthened iron-base material by a method involving consolidating the alloy, in its particulate form, and working the consolidated body to the desired product shape.

According to the present invention there is provided a method of producing products composed of a mechanically-alloyed, dispersion-strengthened iron-base material in which method the alloy, in its mechanically alloyed particulate form, is consolidated and the consolidated body is worked to the desired product shape, said method being characterised by subjecting the alloy to at least two recrystallisation anneals; at least the second and any further recrystallisation anneals being preceded by a working operation which imparts stored internal energy to the body.

The invention has particular application to dispersion-strengthened ferritic alloys which are produced by mechanical alloying in an argon or argon-containing atmosphere and which, when subjected to recrystallisation annealing, exhibit extreme grain coarsening. For example, after mechanical alloying and consolidation, the particulate alloy may have a grain size of the order of 1 to 3 microns (or less) but, when subjected to recrystallisation annealing at temperatures of the order of 1300° C., yield a coarse grain size ranging from millimeters to centimeters (and even greater).

Such grain coarsening may be desirable for some applications—see for example British Pat. No. 1407867 which discloses grain coarsening, by recrystallisation annealing, as a means of rendering certain high temperature alloys suitable for production of components, such as turbine vanes, burner cans and blades, requiring strength and corrosion resistance at high temperatures. However such coarse-grained alloy materials are undesirable in other applications, especially for the production of the tubular cladding of liquid metal cooled fast breeder nuclear reactor fuel pins where the wall thickness of the cladding is typically 0.015 inch (0.38 mm). Ideally such cladding materials should have a grain size such that there are at least 10 grains across the wall thickness of the cladding.

British Pat. No. 1524502 discloses a mechanically-alloyed, dispersion-strengthened ferritic alloy which shows promise as a fast reactor cladding material because it should exhibit good resistance to swelling under neutron irradiation and have adequate high temperature ductility. However, difficulties have been encountered in processing the material as supplied by the patentees (14 Cr: 1Ti: 0.3 Mo: 0.25 $Y_2O_3$: balance Fe) because the material, after hot extrusion from the consolidated mechanically alloyed powder, is very hard as a result of, amongst other things, the small grain size (of the order of 1 to 3 microns) and also the stored internal energy introduced by the extrusion process. This material when heat-treated at 1350° C. for 1 hour, has been found to recrystallise in a similar manner to the materials disclosed in British Pat. No. 1407867 in that a very coarse grain size (typically of the order of millimeters to centimeters) is obtained and the resulting grain size appears not to be amenable to control.

It is thought that this phenomonen of uncontrolled transition from very fine to very coarse grain size may in part be attributable to the entrapment of argon in the material during mechanical alloying; bubbles of argon appear to impose limits on the sites available for nucleation during recrystallisation. It is further speculated that, in the course of grain-coarsening recrystallisation, the argon originally present in bubble form is swept to the grain boundaries and plays no further significant role in influencing grain formation and growth. On the basis of this reasoning, experiments have been conducted to ascertain whether an intermediate grain size could be achieved by subjecting the alloy to further recrystallisation annealing. Although it is not yet established whether the reasoning outlined above is correct, experimental work has indeed shown that further working followed by recrystallisation annealing does produce a grain size which is more acceptable for fast reactor fuel pin cladding, i.e. of the order of 20 to 40 microns.

Thus, in accordance with the invention, the material is subjected to a first recrystallisation anneal to derive the coarse grain condition even though this is considered highly undesirable in terms of producing a product suitable for fast reactor cladding applications; thereafter further recrystallisation annealing is carried out to derive a finer grain size compatible with the requirements for a fast reactor cladding material. The further recrystallisation annealing may be carried out in a single stage or two or more successive stages may be necessary to produce a substantially homogeneous grain structure (preferably without undue grain elongation) of the desired grain size, typically 20 to 40 microns (measurements being made using the mean linear intercept method).

Each stage of further recrystallisation annealing will, in general, be preceded by a suitable working operation which imparts stored internal energy to the lattice structure of the alloy.

The first recrystallisation anneal may be carried out subsequent to consolidation of the particulate alloy. Consolidation may be effected by for example hot extrusion or hot isostatic pressing of the alloy powder. The consolidation process will inevitably impart stored internal energy to the lattice structure of the consolidated body but further working of the consolidated body, for example by hot rolling, may be employed prior to carrying out the first recrystallisation anneal.

In an alternative procedure, the first recrystallisation anneal may be carried out as part of or an extension to the consolidation step.

Where consolidation is effected by hot extrusion, the mechanically alloyed powder may, in known manner, be sealed in a can (of mild steel usually) and extruded together with the can at a temperature of the order of 1065° C. In this event, the first recrystallisation anneal is preferably carried out prior to removal of the can to minimise the risk of oxidation and at a higher temperature than that at which consolidation is effected.

The first recrystallisation anneal may typically be at a temperature of the order of 1350° C. for an interval of about 1 hour. The consolidated body may then be worked, e.g. by cold rolling, to a reduction of say 50% before being subjected to a second recrystallisation anneal at a temperature of the order of 1100° C. or greater for an interval of about 1 hour or longer. Further working and recrystallisation annealing may be employed according to the final grain structure required.

The second and any subsequent recrystallisation anneal may be carried out at temperatures somewhat lower than the first, e.g. of the order of 1100° C./1150° C. compared with 1350° C. It is therefore feasible for the second (and any subsequent) recrystallisation anneals to be carried out after any or all stages, complete or intermediate, of reduction of the consolidated body, for example by extrusion to tube shell, or tube reduction to tube hollow, or by drawing, into long lengths of thin walled tubing (typically of the order of 9 feet—about 2.4 meters—for fast reactor fuel pin cladding) since it is practicable to operate an oven of the requisite dimensions at temperatures of the order of 1100° C. to 1150° C. whereas temperatures of the order of 1350° C. are problematic for ovens of such dimensions. Thus, the first recrystallisation anneal may be carried out before the consolidated body has undergone any extensive elongation whereas the subsequent recrystallisation anneal(s) may be performed after the body has undergone extensive elongation, for instance after the body has been worked to its final shape.

In a further development of the invention, the first recrystallisation anneal may be carried out prior to consolidation, i.e. while the alloy is in its particulate form. This has the advantage that the particle size (typically several hundred microns) of the mechanically alloyed powder imposes a physical limit on the extent to which grain coarsening can occur. The second (and any subsequent) recrystallisation anneal may then be carried out during and/or after consolidation of the alloy powder. However, the possibility of the second (and any subsequent) recrystallisation being carried out before consolidation is not excluded since this would be feasible after the first anneal if further stored internal energy is imparted to the particles by subjecting the powder to additional milling after the first recrystallisation anneal, i.e. using an attitor mill as used conventionally in mechanical alloying.

Although mechanical alloying is a relatively recently developed powder metallurgical process, it is sufficiently well-known in the art for a detailed description to be unnecessary herein. Such details may be obtained from the literature—for example Metals Handbook, 9th Edition, Vol 7, Pages 722–727.

Where the first recrystallisation is carried out while the alloy is in powder form, the temperature and time interval is preferably such as to procure recrystallisation while maintaining the composition of the individual particles substantially unchanged; some expulsion of argon may occur from the individual particles if the previously-mentioned mechanism governing grain coarsening is correct.

In practice, it may be possible to confine the heat treatment to a relatively short interval of time so that diffusion of the solute in each particle is confined to a level where no significant loss and hence composition change occurs. Recrystallisation may be effected for instance by flash annealing. This may involve subjecting the alloy particles to rf heating to an elevated temperature in a protective atmosphere such as hydrogen or argon. In one embodiment, the particles may be packed to a substantially uniform cross-section within a suitable container, such as a silica tube, within the electric/magnetic field produced by a coil energised with high frequency electric current. In an alternative embodiment, the particles may be caused or allowed to fall through the electric/magnetic field produced by an rf coil. In yet another alternative, the particles may form a fluidised bed (using the protective gas as the fluidising medium) and heated rapidly, e.g. by means of an rf heating source.

The alloy employed in the method of the invention may have the composition specified in British Pat. No. 1524502, the preferred composition being 14% chromium, 1% titanium, 0.3% molybdenum, 0.25% yttria and balance iron, derived by mechanically alloying a blend of titanium/molybdenum/chromium master alloy powder, iron powder and yttria powder in an argon atmosphere.

Typically, the hot consolidation will result in the extrusion of a tubular shell which may be subsequently processed to thin walled tubing for use as fuel pin cladding.

In one example of the invention a feedstock consisting of Ti, Cr, Mo master alloy powder, Fe powder and yttria powder is mechanically alloyed in an argon atmosphere. The resulting alloyed particles are sieved to remove oversize particles, leaving approximately 80% of the powder particles which are fed into a mild steel can (typically a 70–200 Kg payload may be used) and hot extruded at approximately 1150° C. with the aid of a fibreglass lubricant. The mild steel is machined off the extruded bar stock and the product is hot rolled at 1150° C. to sheet form followed by subsequent cold rolling to a 1 mm thick sheet. The first recrystallisation anneal can be accomplished by heat treatment in 1 hour at 1350° C. although lower temperatures, down to about 1300° C., are contemplated with more protracted annealing times. A typical grain size at this stage, in a sample strip cut from 1 mm sheet, is approximately 10 cm × 1 cm × 500 microns, the grains being generally pancake-shape.

Subsequent to the initial recrystallisation and following cold working defined by a 50% reduction in thickness effected by cold rolling the 1 mm sheet, further recrystallisation can be accomplished at about 1100° C. with an anneal of about 4 hours or longer.

Such recrystallisation may be facilitated by heavier cold work, i.e. greater than 50% reduction in thickness. Specimens annealed at 1100° C. for 16 hours exhibited a mean linear intercept grain size in longitudinal sections of approximately 50 microns following recrystallisation. Further recrystallisation anneals, each time preceded by cold working, may be effected to reduce grain size still further.

I claim:

1. A method of producing products composed of a mechanically-alloyed, dispersion-strengthened iron-base material comprising the steps of consolidating the alloy, in its mechanically alloyed particulate form, and processing the consolidated body to the desired product shape, the improvement comprising subjecting the alloy to at least two recrystallisation anneals, at least the second and any further recrystallisation anneals being preceded by a working operation which imparts stored internal energy to the body.

2. A method as claimed in claim 1 in which each recrystallisation anneal is effected subsequent to consolidation of the particulate alloy.

3. A method as claimed in claim 2 in which the first recrystallisation anneal is performed after consolidation without any intervening working of the consolidated body.

4. A method as claimed in claim 2 in which the first recrystallisation anneal is performed after working of the consolidated body.

5. A method as claimed in claim 2 in which said consolidation step involves hot extrusion of the particulate alloy while packed in a container and in which at least the first recrystallisation anneal is carried out before removal of the container.

6. A method as claimed in claim 1 in which the first recrystallisation anneal is carried out in the course of hot consolidating the particulate alloy.

7. A method as claimed in claim 1 in which at least the first recrystallisation is carried out while the alloy is in its mechanically particulate form.

8. A method as claimed in claim 1 in which said material has been produced by mechanical alloying of its constitutents in an argon or argon-containing atmosphere.

9. A method as claimed in claim 1 in which the alloy is one which, in response to initial recrystallisation annealing, undergoes substantial grain-coarsening to an extent which, in the case of the consolidated alloy, would result in a grain size in excess of one millimeter.

10. A method as claimed in claim 1 in which the alloy is produced by mechanically alloying a titanium/-molybdenum/chromium powder, an iron powder and yttria powder.

11. A method of producing a powder metallurgical alloy comprising mechanically alloying the constitutents of the alloy and subjecting the alloy, while still in its mechanically alloyed particulate form, to recrystallisation annealing.

12. A method as claimed in claim 11 comprising hot consolidating the recrystallised alloy powder, working the same to a final product shape and carrying out at least one further recrystallisation anneal either in the course of working the material to the final shape or subsequently.

13. A product which has been manufactured by the method of claim 1.

14. A thin-walled tubular product with a wall thickness in the range of 20 to 40 microns, produced by the method of claim 1.

15. A method of producing products composed of a mechanically-alloyed, dispersion-strengthened iron-base material having a composition of 14% chromium, 1% titanium, 0.3% molybdenum, 0.25% yttria and the balance iron produced by mechanically alloying a titanium/molybdenum/chromium powder, an iron powder and yttria powder, comprising the steps of consolidating the alloy, in its mechanically alloyed particulate form, and processing the consolidated body to the desired product shape, and subjecting the alloy to at least two recrystallisation anneals, at least the second and any further recrystallisation anneals being preceded by a working operation which imparts stored internal energy to the body.

16. A method as claimed in claim 15 wherein the alloy is ferritic.

* * * * *